United States Patent [19]

Seal

[11] Patent Number: 4,662,631

[45] Date of Patent: May 5, 1987

[54] BENCH-TYPE EXERCISING APPARATUS

[75] Inventor: John Seal, Auburn, Ala.

[73] Assignee: Diversified Products Corporation, Opelika, Ala.

[21] Appl. No.: 696,745

[22] Filed: Jan. 31, 1985

[51] Int. Cl.[4] ..... A63B 13/00

[52] U.S. Cl. ..... 272/123; 272/144

[58] Field of Search ..... 272/123, 117, 118, 134, 272/145, 144, 93; D21/191

[56] References Cited

U.S. PATENT DOCUMENTS

| | | | |
|---|---|---|---|
| Re. 26,606 | 6/1969 | Dodge . | |
| 3,342,485 | 9/1967 | Gaul . | |
| 4,319,747 | 3/1982 | Rogers | 272/123 X |
| 4,369,966 | 1/1983 | Silberman et al. . | |
| 4,432,865 | 1/1984 | Mahnke . | |
| 4,575,077 | 3/1986 | Osborne et al. | 272/123 X |

FOREIGN PATENT DOCUMENTS

| | | | |
|---|---|---|---|
| 2076299 | 12/1981 | United Kingdom | 272/144 |

OTHER PUBLICATIONS

The Bruce Jenner Bench, AMF Whitley 1980 catalog.
Extra-Heavy Squat Rack-Supine Press Bench Combination, Marcy catalog, 1969, p. 14.
1978 Best Products catalog.
F/W 1977 J. C. Penney catalog.

*Primary Examiner*—Richard J. Apley
*Assistant Examiner*—J. Welsh
*Attorney, Agent, or Firm*—Banner, Birch, McKie & Beckett

[57] ABSTRACT

A bench-type exercise apparatus with a head end and a foot end is disclosed. The apparatus comprises a seat formed in a plurality of sections including a first seat portion and an inclinable seat portion adjacent the head end of the apparatus and pivoted adjacent the first seat portion. A frame supports the seat portions above the floor and includes at least one leg adjacent the foot end of the apparatus and at least one intermediate leg intermediate the ends of the apparatus. A pair of floor-engaging base legs are connected to the intermediate leg and diverge from it laterally outward and toward the head end of the apparatus. A pair of upright barbell support posts flank the inclinable seat portion, are connected to the base legs and extend upward therefrom. At least one pair of barbell cradles extend from the support posts toward the foot end of the apparatus for supporting a barbell used in bench exercises by a user supported on the seat. A squat exercise barbell cradle is also attached to each support post for supporting a barbell used in squat exercises by a user standing at the head end of the apparatus in the area between the diverging base legs. A pivotal abdominal/back exercising attachment is attached to the support posts for pivotal motion about a pivot axis. The exercising attachment includes a pivot arm pivoted to each of these support posts and having a weight support mechanism on one side of the pivot axis. A torso engaging portion generally on the opposite side of the pivot axis interconnects the pivot arms and is engaged by the front or back of the torso of a user seated on the seat whereby bending movement of the user's torso about the waist pivots the exercising attachment against the force of weights on the weight support mechanism.

10 Claims, 11 Drawing Figures

BENCH-TYPE EXERCISING APPARATUS

TECHNICAL FIELD

The present invention relates to exercising devices for developing and conditioning various parts of the body and, more particularly, to a bench-type exercising device which is compact, stable and incorporates an abdominal/back exercising attachment.

BACKGROUND OF THE INVENTION

The importance of regular exercise for building and maintaining strength and endurance cannot be overemphasized. The modern conveniences which we enjoy and the sedentary tasks which we increasingly perform have given us a comfortable lifestyle at the expense of physical fitness. Highly active exercise programs, such as running, develop endurance of the cardiovascular system. Muscular strength and endurance is best developed through weight training.

The simplest and least expensive apparatus for weight training is the barbell with removable weights. However, the use of a barbell alone cannot develop all areas of the body. Hence, additional apparatus must be employed for a comprehensive conditioning program. Devices developed for this purpose generally provide the user with a force resister against which muscular effort must be applied. Resistance is typically provided by means of a weight and pulley arrangement, or an elastic element. These devices permit the force to be applied to the user's body from many different directions in order to develop substantially all areas of the body.

Few of these weight training devices, however can provide the user with substantially all of the exercising variants required to develop the entire body. Those that do are generally large, complex and costly machines which occupy a substantial amount of space, cannot be used with a common barbell set and consequently are not suitable for home use. These are usually found only at health clubs and other athletic establishments. More specialized devices for developing limited areas of the body are available, but a number of different devices of this type must be used in order to provide a complete range of exercises.

SUMMARY OF THE INVENTION

Accordingly, it is an object of the present invention to obviate the above-noted disadvantages of the prior art by providing a simple, compact and inexpensive exercise apparatus for performing a number of weight training exercises.

Another object of the invention is to provide such an apparatus which is self-supporting yet strong, stable and relatively compact.

Another object of the invention is to provide a uniquely stable bench-type exercising apparatus wherein support is provided intermediate the ends of the apparatus and diverges therefrom to provide stable support during various exercises.

Another object of the invention is to provide a support frame wherein compactness of the apparatus is enhanced by supporting the barbell on a common barbell support post for both bench exercises and squat exercises.

Another object of the invention is to provide an abdominal/back exercising attachment for use with the apparatus.

The above and other objects of the present invention are accomplished by providing a bench-type exercising apparatus comprising a seat, a support frame for supporting the seat at a position above the floor, two upright support posts flanking the seat, and a pivotal abdominal/back exercising attachment. A mechanism is provided for connecting the exercising attachment to the support posts for pivotal motion about a pivot arm. The exercising attachment includes a pivot arm pivoted to each of these support posts and having a weight support mechanism on one side of the pivot axis. A torso engaging portion generally on the opposite side of the pivot axis interconnects the pivot arms and is engaged by the front or back of the torso of a user seated on the seat whereby bending movement of the user's torso about the waist pivots the exercising attachment against the force of weights on the weight support mechanism.

The invention is also directed to a bench-type exercise apparatus with a head end and a foot end, and comprising a seat formed in a plurality of sections including a first seat portion and an inclinable seat portion adjacent the head end of the apparatus and pivoted adjacent the first seat portion. A frame mechanism supports the seat portions above the floor and includes at least one leg adjacent the foot end of the apparatus and at least one intermediate leg intermediate the ends of the apparatus. A pair of floor-engaging base legs are connected to the intermediate leg and diverge from it laterally outward and toward the head end of the apparatus. A pair of upright barbell support posts flank the inclinable seat portion, are connected to the base legs and extend upward therefrom. At least one pair of barbell cradles extend from the support posts toward the foot end of the apparatus for supporting a barbell used in bench exercises by a user supported on the seat. A squat exercise barbell cradle is also attached to each support post for supporting a barbell used in squat exercises by a user standing at the head end of the apparatus in the area between the diverging base legs.

BRIEF DESCRIPTION OF THE DRAWINGS

The novel features of the invention are set out with particularity in the appended claims, but the invention will be understood more fully and clearly from the following detailed description of the invention as set forth in the accompanying drawings, in which:

DESCRIPTION OF THE INVENTION

In the preferred embodiments shown in the Figures, most of the structural elements of the invention are tubular or channel-shaped steel members which are secured together by bolted connections. Of course, other types of members of various cross-section may be used, and they may be secured together by other means, such as welding.

Figure 1:
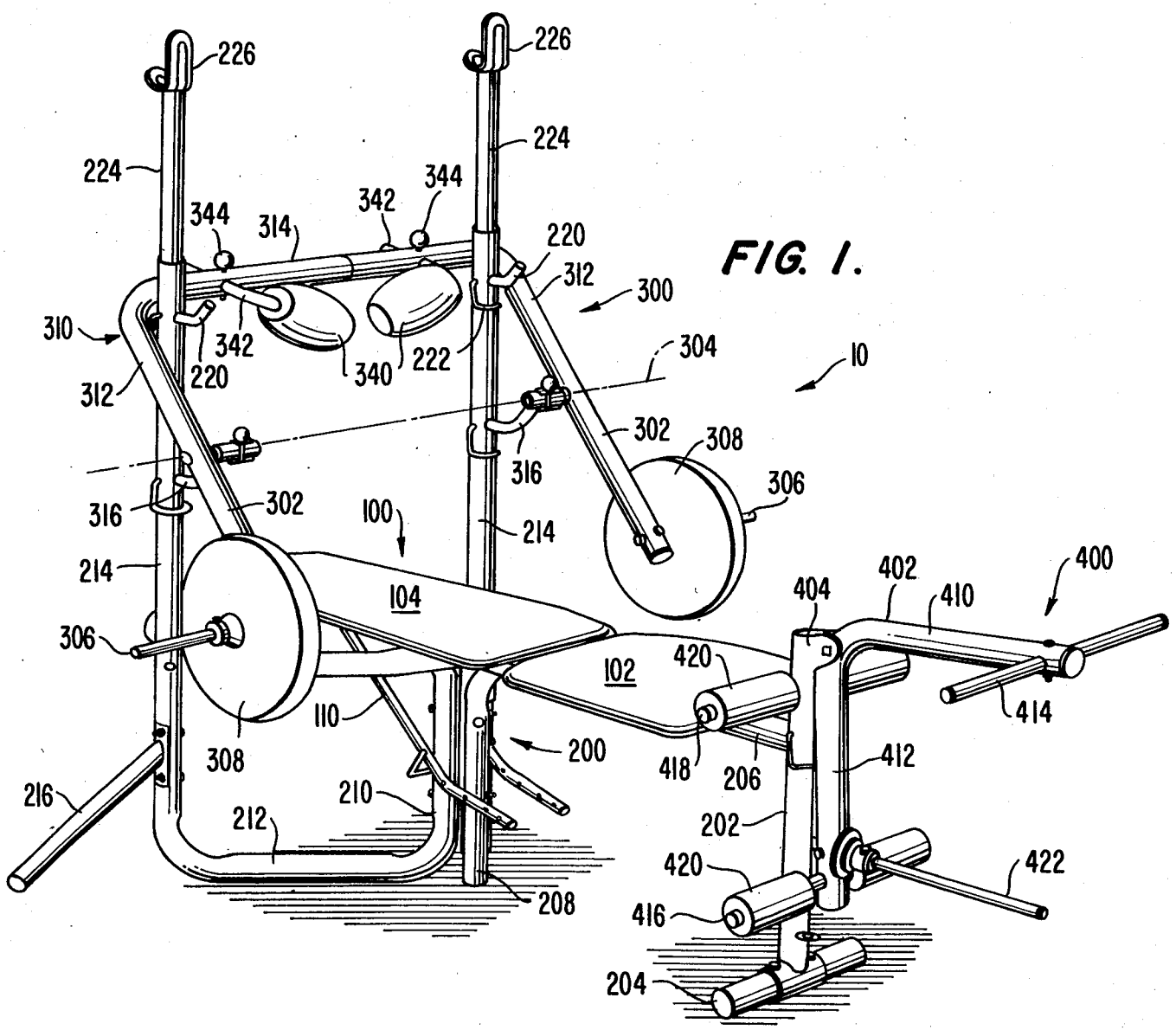
FIG. 1 is a perspective view of the exercising apparatus according to the invention, including the abdominal/back exercising attachment.

Referring to FIG. 1, a bench-type exercising apparatus according to the invention, designated generally as 10, is illustrated. Exercising apparatus 10 includes a seat 100 supported by a frame 200. An abdominal/back exercising attachment 300 is supported for pivotal motion by frame 200, and a leg lift device 400 is removably attached to frame 200.

Figure 2:
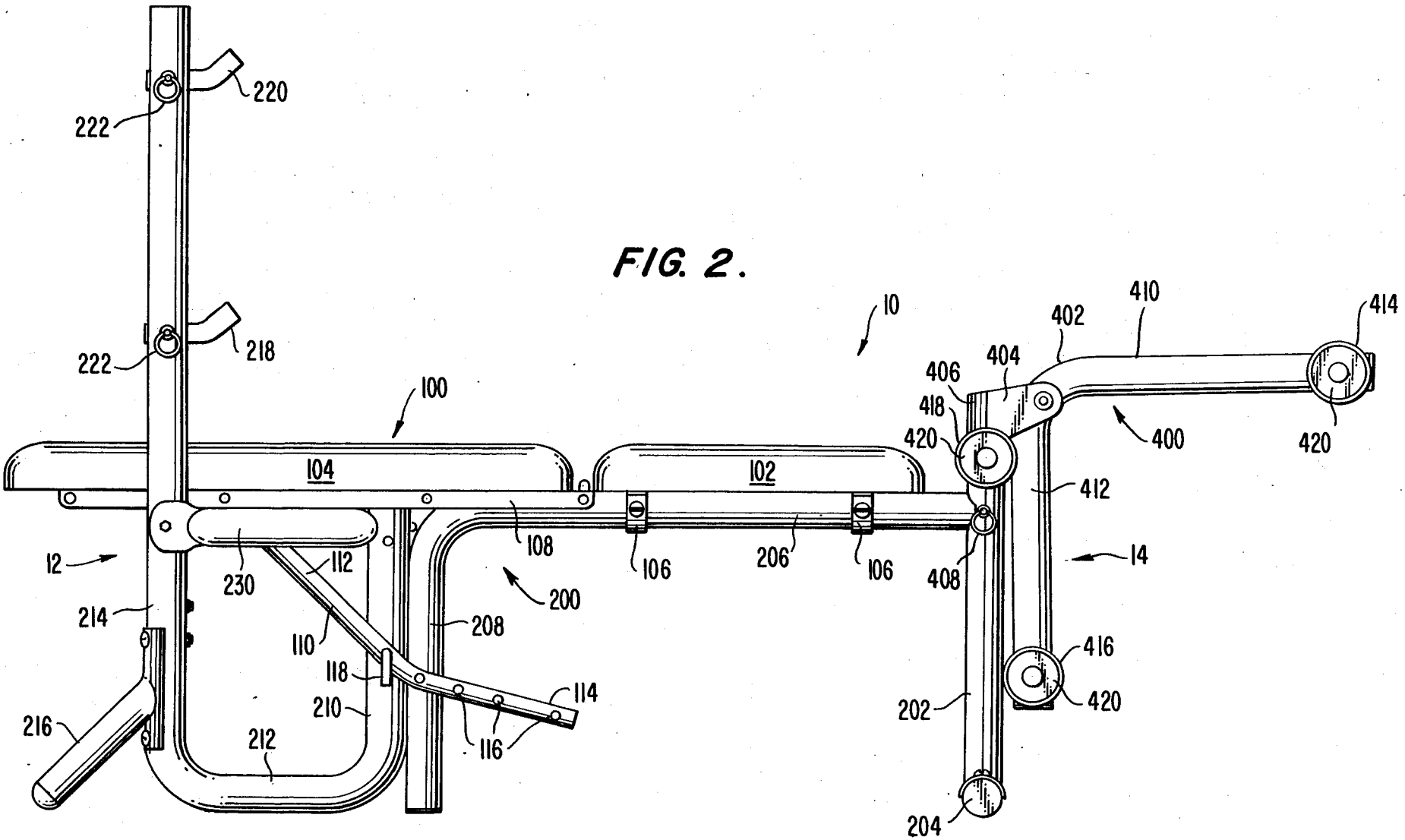
FIG. 2 is a side view of the exercising apparatus without the abdominal/back exercising attachment.

As shown in FIG. 2, exercising apparatus 10 has a head end 12 and a foot end 14; i.e. a user lying on the apparatus during bench exercises would rest his/her head adjacent head end 12 and their feet adjacent foot end 14.

Frame 200 includes a generally vertically extending leg 202 adjacent foot end 14. An elongate floor engaging member 204 is connected to the lower end of leg 202 to provide an extended ground engaging base. A longitudinal member 206 is connected to leg 202 at a level above the floor and extends therefrom toward head end 12. A forward intermediate leg 208 is connected to longitudinal member 206 and extends downward to floor contact. Longitudinal member 206 and forward intermediate leg 208 can be formed of a single integral tubular member. Leg 208 is located intermediate head end 12 and foot end 14.

Figure 3:
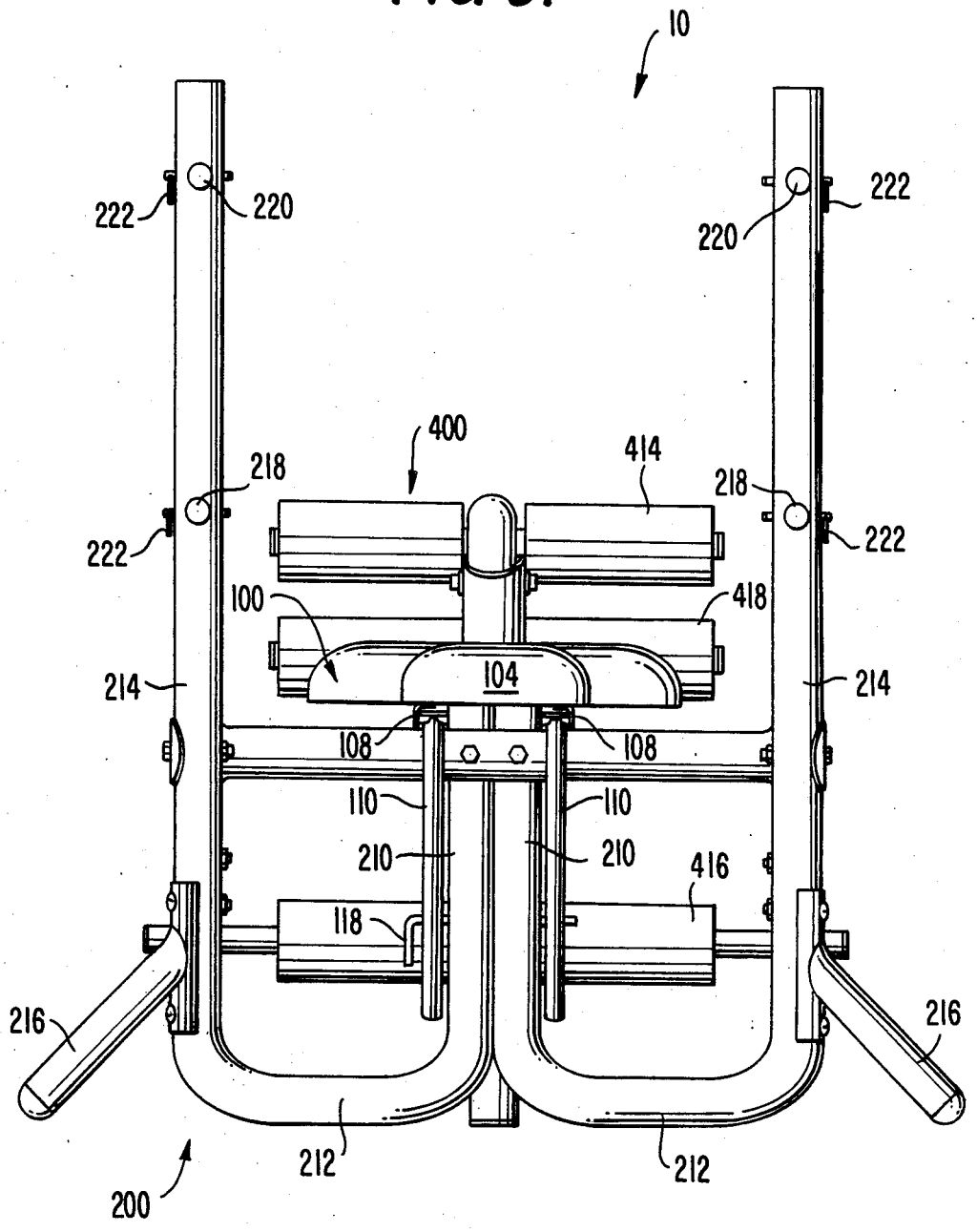
FIG. 3 is an end view from the head end of the apparatus illustrated in FIG. 2.
Figure 4:
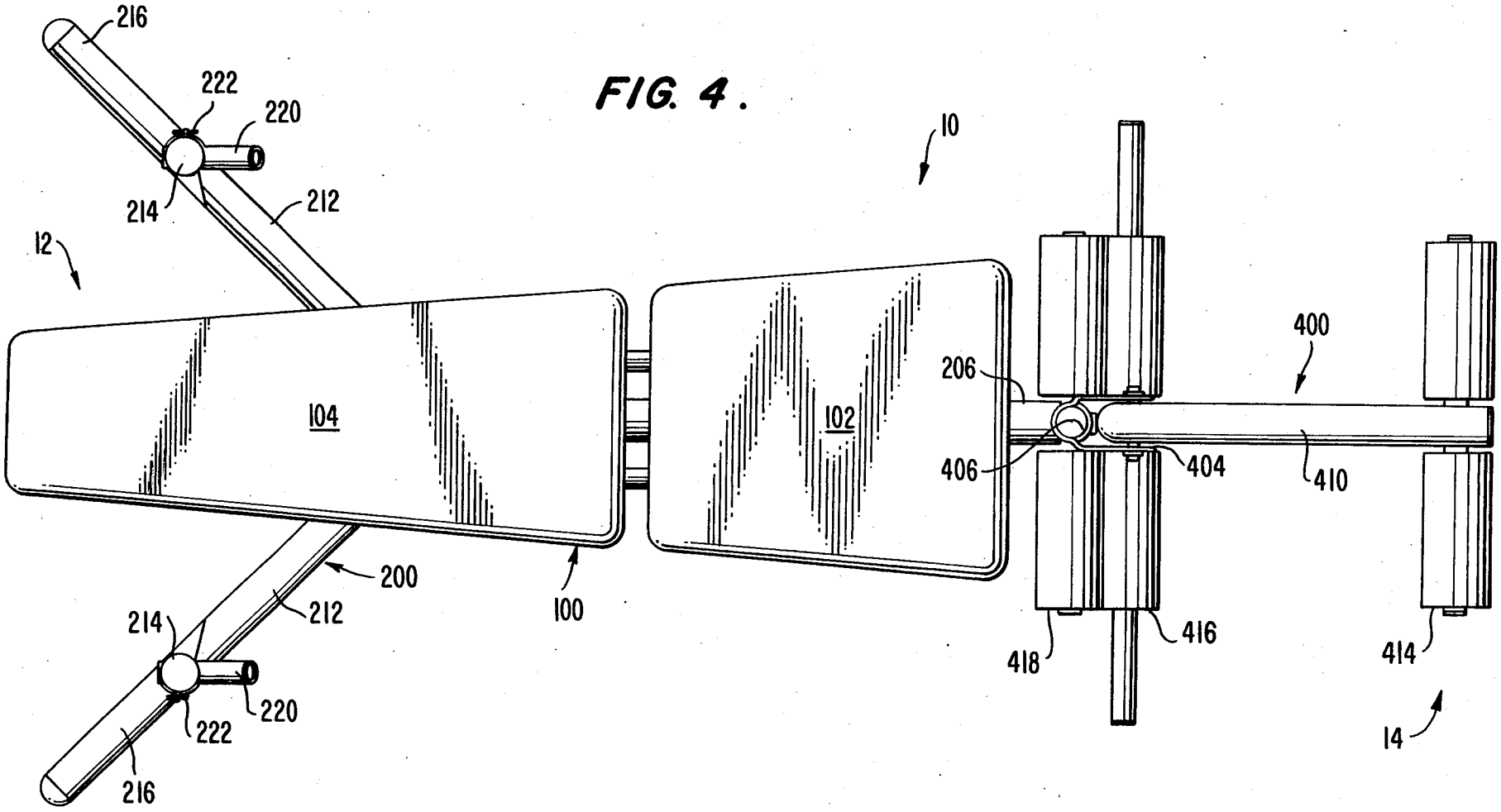
FIG. 4 is a top plan view of the apparatus illustrated in FIG. 2.

As best seen in FIG. 3, frame 200 includes two rear intermediate legs 210 also located intermediate head and foot ends 12, 14. Each leg 210 extends vertically from seat 100 to a floor-engaging base leg 212. Each leg 12 is connected to one rear intermediate leg 212, preferably formed integral with it, and diverges laterally outwardly and toward head end 12. See FIGS. 1 and 4. An upright barbell support post 214 is connected to, preferably formed integral with, and extends upwardly from each base leg 212. Additional lateral stability is provided to frame 200 by attaching a supplemental stabilizing leg 216 to each post 214. Legs 216 are connected to posts 214 at a level above the floor and extend therefrom laterally outward and downward, and toward the head end of the apparatus.

Pairs of barbell support cradles 218, 220 are removably attached by connecting pins 222 to support posts 214 at vertically spaced locations. Barbell cradles 218, 220 extend from support posts 214 toward foot end 14 in order to support a barbell used in bench exercises.

Support posts 214 have vertically extendible upper portions 224 with barbell cradles 226 attached adjacent their upper ends. See FIG. 1. Cradles 226 support a barbell used in squat exercises by a user standing at head end 12 in the area between diverging base legs 212. During such squat exercises, a portion of seat 100 is pivoted out of the way, in a manner described hereinafter, and exercise attachment 300 is not attached to the apparatus. The configuration of frame 200 thus provides a compact stable support for performing both bench and squat exercises with a barbell, eliminating the need of separate support posts for the barbell in bench and squat exercises.

Seat 100 is formed in a plurality of sections including a first seat portion 102 and an inclinable seat portion 104. Seat 102 is attached to frame 200 in any conventional manner such as with clamps or brackets 106 connected to longitudinal member 206. Inclinable seat 104 is attached to laterally spaced rails 108. The end of inclinable seat portion 104 which is adjacent first seat portion 102 is pivotably connected to frame 200 by means of a pivot pin extending through rails 108 and longitudinal support member 206. A support bar 110 has a first section 112 pivotably connected to inclinable seat 104 through rails 108 and a second section 114 which extends from first section 112 at an obtuse angle. A plurality of apertures 116 are formed through first and second sections 112, 114 of bar 110. Inclinable seat 104 is adjustably positioned at various inclined positions by inserting a connecting pin 118 through on of the various apertures 116 and passing the connecting pin 118 through alignable poles in both rear intermediate legs 210. As seen in FIG. 3, a support bar 110 is pivotably connected to each rail 108 and pin 118 passes through both bars 110. In its horizontal position, inclinable seat portion 104 rests on a horizontal support member 230 of frame 200. Support member 230 is connected to and extends between upright posts 214 and rear intermediate legs 210 at a vertical level which supports inclinable seat 104 in a horizontal orientation.

Figure 9:
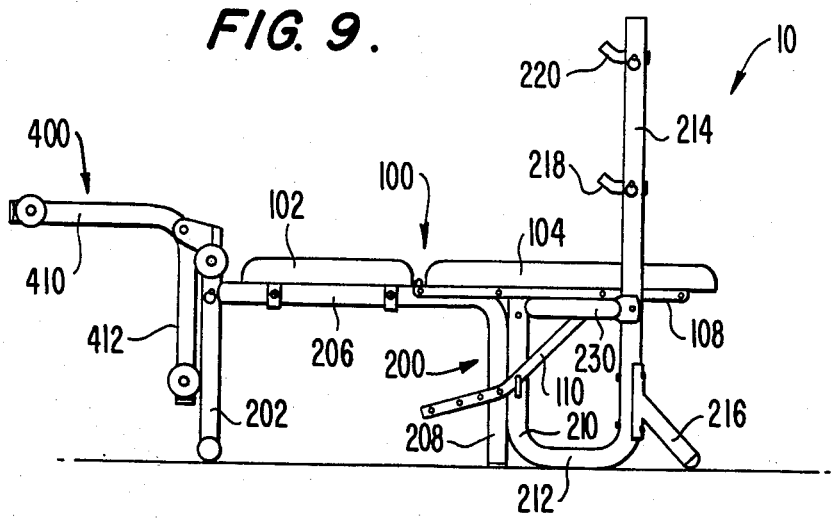
FIGS. 9, 10 and 11 are side views of the apparatus illustrating a leg exercise attachment connected to the foot end of the apparatus and illustrating the inclinable seat portion held at various positions.
Figure 10:
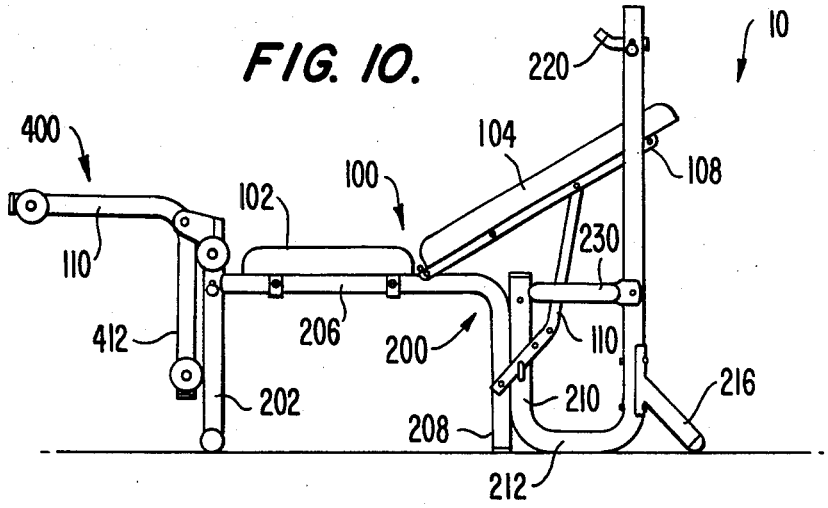
Figure 11:
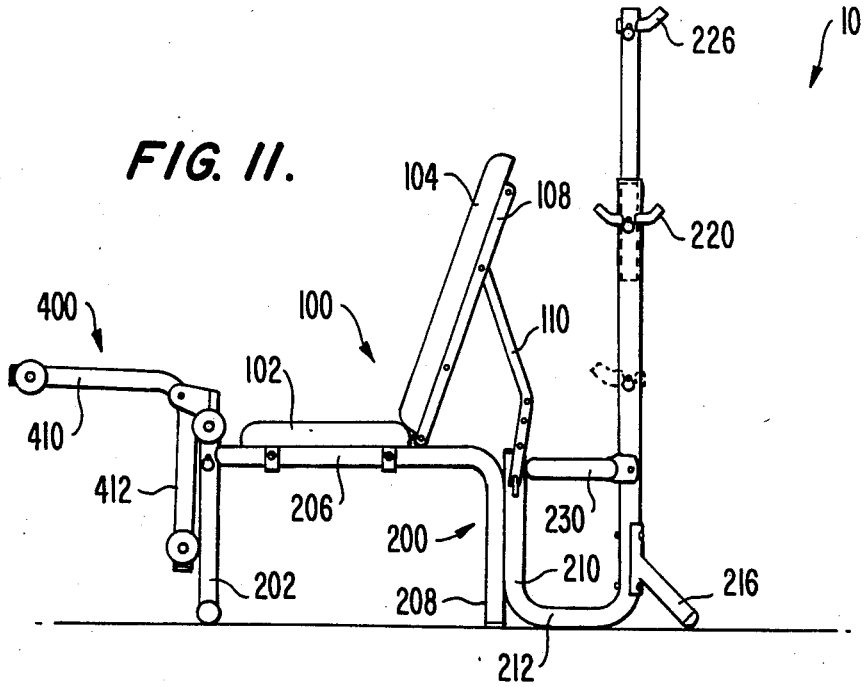

FIG. 9 illustrates seat portion 104 in a horizontal orientation and both pairs of cradles 218, 220 are inserted in posts 214 so that a barbell can be supported at both vertical levels. In FIG. 10, seat portion 104 is inclined a certain degree and only the upper barbell cradles 222 are in place to support the barbell. In FIG. 11 seat portion 104 is pivoted upward to its maximum degree so that it does not extend into the area between upright posts 214. In this position, a user can step into the area between support posts 214 and diverging base legs 212 to perform barbell squat exercises. The barbell can be supported on cradles 220 which can be turned to face the head end of the apparatus, or on the uppermost cradles 226 attached to extendible portion 224 of support posts 214. As shown in FIG. 11 cradles 226 can be made removable, adjacent the top of extendible portion 224, rather than fixedly attached to the extendible portion 224 as shown in FIG. 1. Also in the position shown in FIG. 11, seat portion 104 provides back support during leg exercises with leg lift device 400.

Various auxiliary exercise devices can be attached to leg 202 at foot end 14. Leg lift device 400, illustrated in FIGS. 1, 2, 3, 4, 9, 10 and 11 is one such auxiliary device. Leg lift device 400 is comprised of a pivoted member 402 pivotably carried by a yoke 404, which in turn is attached to a tubular connecting member 406. Leg 202 is tubular and has an open top through which tubular connecting member 406 is inserted and fixed in position by a connecting pin 408. Pivoted member 402 includes an upper arm 410 and a lower arm 412 extending from it at right angle. An upper ankle engaging member 414 extends transversely from the outer end of upper arm 410, and a lower ankle engaging member 416 extends transversely from a lower end of lower arm 416. A knee support 418 extends transversely from tubular connecting member 406. Cushioning pads 420 preferably cover the outer surface of engaging members 414, 416 and knee support 418. In the leg left device illustrated in FIG. 1, weights are added to a central weight support rod 422. In the embodiment of the leg lift device illustrated in the remaining figures, weights are added to the outer ends of the lower ankle engaging member to provide resistance during exercise.

Figure 8:
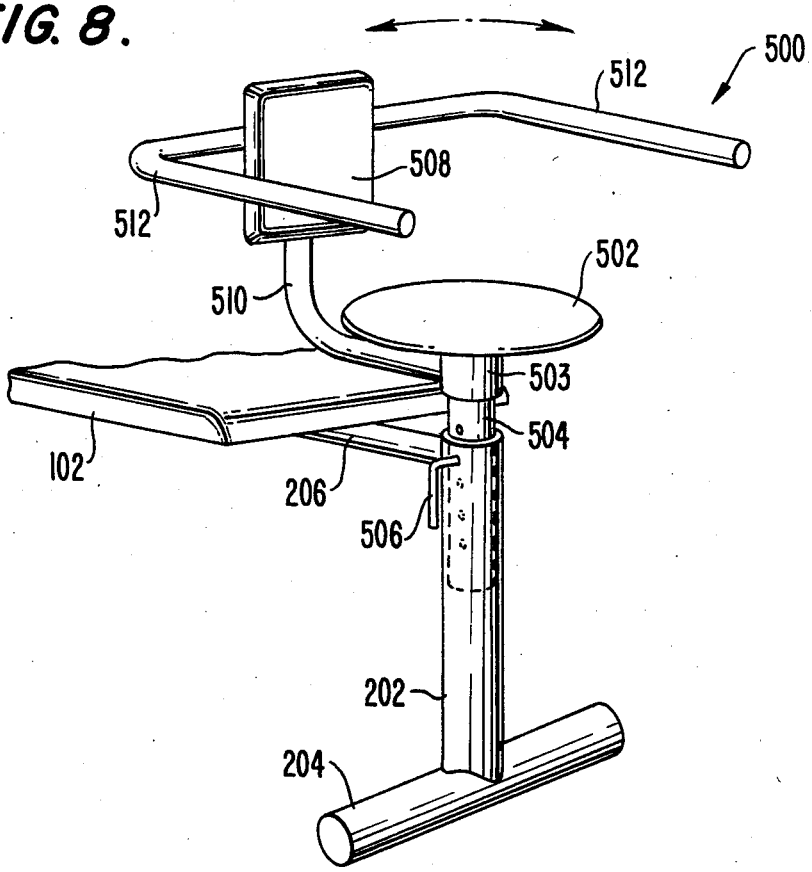
FIG. 8 is a perspective view illustrating the attachment of a torso exerciser to the foot end of the apparatus.

Another type of auxiliary exercising device, a torso twister 500, which can be attached to leg 202 at foot end 14, is illustrated in FIG. 8. Torso twister 500 includes a seat 502 rotatably carried on the top of a connecting tube 504 by a cylinder 503. Connecting tube 504 is inserted into the hollow interior of leg 202 and removably secured therein by a connecting pin 506. A backrest 508 is attached to cylinder 503 through a right angle bar 510. Right angle arm rests or support handles 512 extend from each side of back rest 508. A user of torso twister 500 sits on seat 502 and rotates the seat to perform twisting motions of the torso which exercises muscles in the torso and enhances flexibility.

Details of abdominal/back exercising attachment 300 are illustrated in FIGS. 1, 5, 6 and 7. Exercising attachment 300 is comprised of a pivot arm 302 which is pivotable about a pivot axis 304. A weight support bar 306 for supporting removable weights 308 extends from each pivot arm 302 on one side of pivot axis 304. A torso engaging section 310 extends on the opposite side of pivot axis 304. Torso engaging section 310 includes a lever section 312 extending from each pivot arm 302 away from pivot axis 304 and a transverse section 314 connecting lever sections 312. Transverse section 314 is located on an opposite side of support posts 214 from pivot axis 304.

Pivot arms 302 and torso engaging section 310 of abdominal/back exercising attachment 300 are pivotably carried on support posts 214 by a support bar 316 extending from each support post 214 in a direction toward foot end 14. Support bar 316 has a first section 318 for coupling to support posts 214 and a second section 320 extending at an angle from first section 318. A bracket 322 for rotatably receiving a pivot pin 324 extending from the juncture of pivot arm 302 and lever section 312, i.e. at the pivot axis of exercising attachment 302, is attached to section 320 of support bar 316. First section 318 has an aperture 326 extending through it. Support bar 316 is connected to support posts 214 by passing first section 318 through a hole 328 in support posts 214, and is fixed therein by inserting a connecting pin 330 through another hole 332 in support posts 214 and through aperture 326 in first section 318 of support bar 316. Exercising attachment 300 is pivotably coupled to support bar 316 by inserting pivot pin 324 through an open mouth of bracket 322 and closing the open mouth with a closure pin 334. Axial movement of pin 324 is prevented by a lip 336 and lever sections 312. A pair of tubular shaped pads 340 are removably attached to transverse section 314 by right angle bars 343 and connecting pins 344. Pads 340 provide a comfortable contact surface for the torso of a user.

Figure 5:
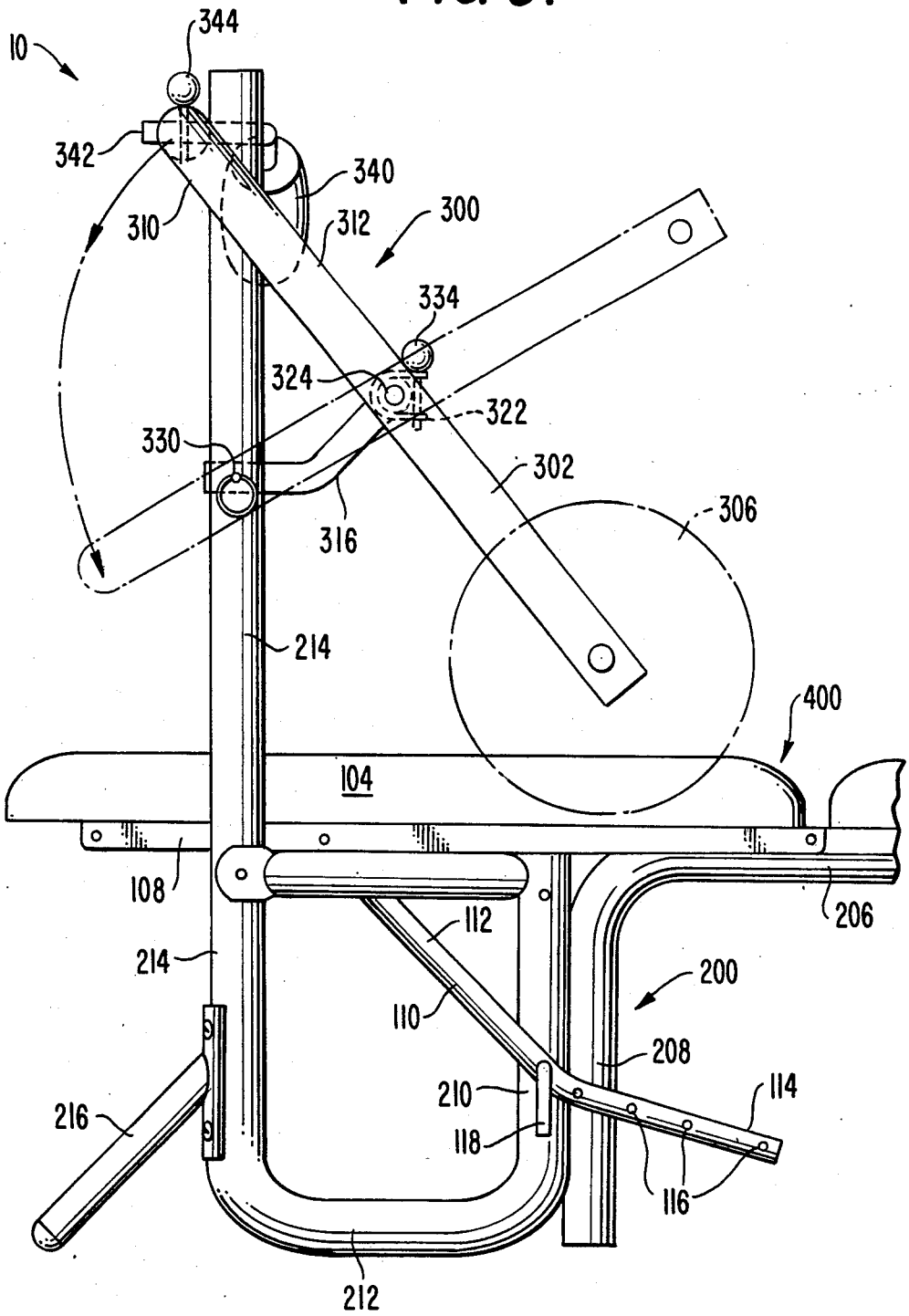
FIG. 5 is a partial side view of the apparatus illustrating the pivotal motion of the abdominal/back exercising attachment held by a support bracket in an upper abdominal exercising position.
Figure 6:
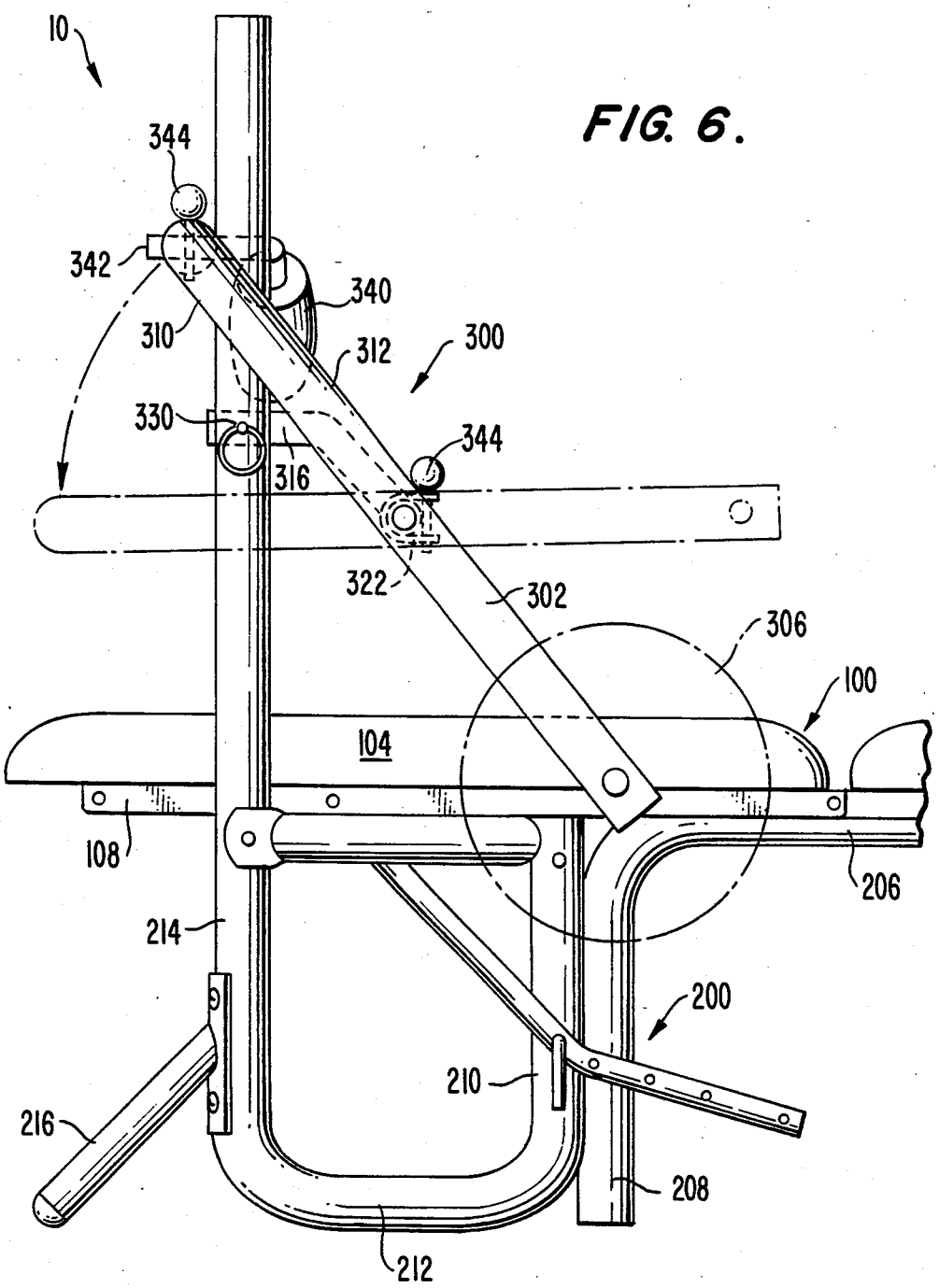
FIG. 6 is a partial side view of the apparatus illustrating the pivotal motion of the abdominal/back exercising attachment held by a support bracket in a lower back exercising position.
Figure 7:
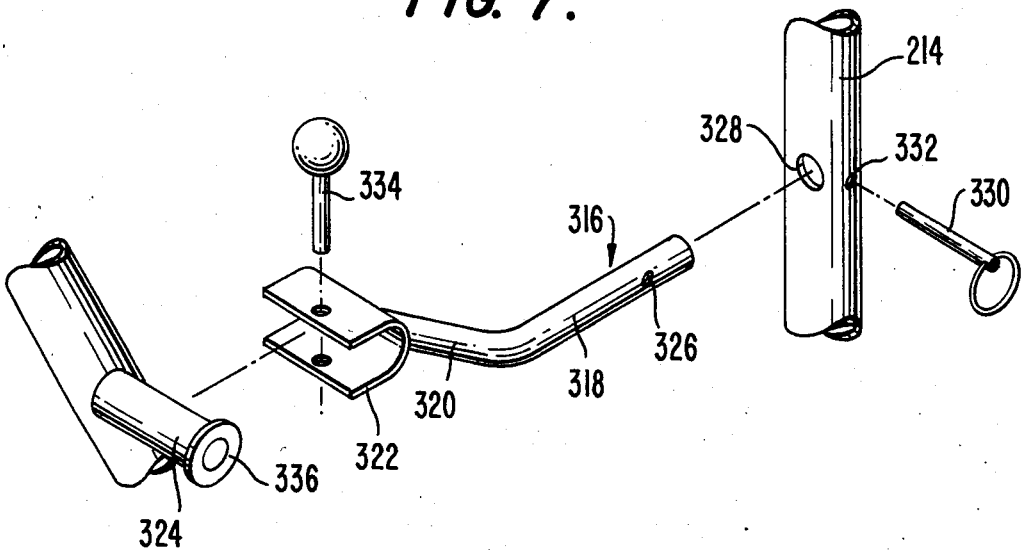
FIG. 7 is an exploded perspective view illustrating the connection of the abdominal/back exercising attachment to the support post.

A user of exerciser attachment 300 can exercise either the abdominal or back muscles. FIG. 5 illustrates exercise attachment 300 set up for abdominal exercises wherein support bars 316 are coupled to support posts 214 in a manner that section 320 extends upward and locates transverse section 314 and pads 340 at a relatively high position. A user sits on seat portion 104 facing toward head end 12 and places his/her legs in the area between the diverging legs 212. The chest is placed in contact with cushions 340 and the user bends forward at the waist to exercise the abdominal muscles. FIG. 6 illustrates exercising attachment 300 set up for back exercises wherein support bars 316 are connected to support posts 214 in a manner that sections 320 extend downward to locate transverse section 314 and pads 340 at a relatively lower location. To exercise the back muscles, the user sits on seat portion 104 facing toward foot end 14 and places his or her back in contact with pads 340. The back muscles are exercised by bending the torso backward. In performing both abdominal and back exercise, the user sits approximately above intermediate legs 208 and 210. These legs are thus located at a maximum stress point, and in combination with diverging legs 212 provide stable, yet compact support.

It will be obvious to one of ordinary skill that numerous modifications may be made without departing from the true spirit and scope of the invention which is to be limited only by the appended claims.

What is claimed:

1. A bench type exercise apparatus having a head end and a foot end and comprising:

a seat formed in a plurality of sections including a first seat portion and an inclinable seat portion adjacent the head end of the apparatus and pivoted adjacent said first seat portion;

frame means for supporting said seat portions above the floor including at least one leg adjacent the foot end of the apparatus and at least one intermediate leg intermediate the ends of said apparatus;

a pair of floor-engaging base legs rigidly connected to said intermediate leg and diverging laterally outwardly and toward the head end of said apparatus from said intermediate leg;

a pair of upright barbell support posts flanking said inclinable seat portion, connected to said base legs and extending upward therefrom;

at least one pair of bench exercise barbell cradles attached to and extending from said support posts toward the foot end of said apparatus for supporting a barbell used in bench exercises by a user supported on said seat and a squat exercise barbell cradle attached to and extending from said support posts toward the rear end of said apparatus for supporting a barbell used in squat exercises by a user standing at the head end of said apparatus in the area between said diverging base legs.

2. An exercise apparatus according to claim 1 including adjustable seat support means for holding said inclinable seat portion in a plurality of inclined positions.

3. An exercise apparatus according to claim 2 wherein said adjustable seat support means includes a support bar having a first section pivotably connected to said inclinable seat portion and a second section extending at an angle from said first section, and means for removably attaching said support bar to said intermediate leg at a plurality of positions along said support bar.

4. An exercise apparatus according to claim 3 wherein the angle between said first and second sections of said support bar is obtuse.

5. An exercise apparatus according to claim 1 wherein said at least one intermediate leg includes a forward intermediate leg connected by a longitudinally extending frame member to said leg adjacent the foot end of the apparatus and rear intermediate legs each connected to one of said base legs.

6. An exercise apparatus according to claim 5 wherein the rear intermediate leg, the base leg and at least a lower portion of the barbell support post on each lateral side of the apparatus is formed of a single integral piece of tubing.

7. An exercise apparatus according to claim 6 wherein each barbell support post includes an extendable upper portion, and said squat exercise barbell cradles are attached to said upper portions of said support post whereby the height at which a barbell is held for squat exercises is adjustable.

8. An exercise apparatus according to claim 1 wherein each barbell support post includes an extendable upper portion whereby the height at which a barbell is held by said squat exercise barbell cradles is adjustable.

9. An exercise apparatus according to claim 1 including a supplemental stabilizing leg connected to each barbell support post at a level above the floor and extending therefrom laterally outwardly, toward the head end of the apparatus and downward to contact with the floor.

10. An exercise apparatus according to claim 1 wherein said leg adjacent the foot end of the apparatus includes means for connecting additional exercise devices to said apparatus.

* * * * *